US006317983B1

(12) United States Patent
Kakimoto

(10) Patent No.: US 6,317,983 B1
(45) Date of Patent: Nov. 20, 2001

(54) ELECTRIC SHAVER

(75) Inventor: Kiyohiko Kakimoto, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 09/343,567

(22) Filed: Jun. 30, 1999

(30) Foreign Application Priority Data

Jul. 3, 1998 (JP) ..... 10-189342

(51) Int. Cl.[7] ..... B26B 19/14
(52) U.S. Cl. ..... 30/34.2; 30/43.6
(58) Field of Search ..... 30/34.2, 43.6, 30/346.51

(56) References Cited

U.S. PATENT DOCUMENTS 3,940,851 * 3/1976 Rookus ..... 30/34.2
5,621,971 * 4/1997 Szymansky ..... 30/34.2 X

FOREIGN PATENT DOCUMENTS

1076528 * 2/1960 (DE) ..... 30/34.2

* cited by examiner

*Primary Examiner*—Douglas D. Watts
(74) *Attorney, Agent, or Firm*—Koda & Androlia

(57) ABSTRACT

An electric shaver with at least one outer cutter provided in a head frame so that the upper surface of the outer cutter that is formed with hair entry apertures protrudes from a hole formed in the head frame, and at least one inner cutter unit which rotates with respect to the outer cutter and has inner cutter elements that contact the inside surface of the upper surface of the outer cutter; and at least one hair-raising ring is disposed on the head frame so as to surround the outer cutter. The upper end surface of the hair-raising ring is formed flat.

6 Claims, 7 Drawing Sheets

ELECTRIC SHAVER

BACKGROUND OF THE INVENTION

1. Field of the Invention

The present invention relates to a rotary type electric shaver and more particularly to an electric shaver which has a hair-raising means provided around the circumferences of the outer cutters.

2. Prior Art

In conventional rotary type electric shavers, there are various inventions and innovations for achieving efficient introduction of hair into hair entry apertures formed in the outer cutters of an electric shaver.

For example, in the rotary type electric shaver described in Japanese Patent Application Publication (Kokoku) No. S60-3503, the efficient introduction of hair is accomplished by a hair-introducing comb. The hair-introducing comb has parallel hair introduction grooves formed so as to correspond to a plurality of hair entry apertures of the outer cutters. These grooves are obtained by forming protruding ribs parallel to each other at intervals along the outer circumference of the circumferential wall of the outer cutter.

On the other hand, in the shaving device described in Japanese Utility Model Application Publication (Kokoku) No. H3-17830, a brush which is used to stretch hair or cause the hair to stand in upright positions is installed on a holder on which a shaver head is mounted. The respective rigid bristles of this brush is formed with hooks at the free ends. As a result, the tip ends of the rigid bristles can securely catch on the back portions of the hair lying flat along the skin, so that the hair is caused to stand upright and are easily captured inside the hair entry aperture.

However, these conventional electric shavers have problems.

First, in the electric shaver equipped with a hair introducing comb as described in Japanese Patent Application Publication (Kokoku) No. S60-3503, since the object of the shaver is to arrange long hair and kinky hair so that such hair is introduced into the hair entry apertures, the shaver is effective for such hair. However, this shaver cannot raise hair that is lying flat along the skin so as to introduce into the hair entry apertures.

In the shaver with a brush as described in Japanese Utility Model Application Publication (Kokoku) No. H3-17830, hair, debris, etc. tend to adhere to the brush, and therefore, a thorough cleaning of the device is not easy. Thus, such a shaver suffers from the problem of being kept unclean.

SUMMARY OF THE INVENTION

Accordingly, the present invention is to solve the above-described problems.

The main object of the present invention is to provide an electric shaver that can efficiently raise the individual hairs that are lying flat and introduce such hairs into hair entry apertures formed in the outer cutters.

It is another object to provide an electric shaver with which the shaving debris can be cleaned away simply.

The above objects are accomplished by a unique structure for an electric shaver which is equipped with outer cutters mounted in a head frame so that the upper surfaces of these outer cutters, in which a plurality of hair entry apertures are formed, protrude from circular holes formed in the head frame, and inner cutter units which have a plurality of inner cutter elements that contact the inside surfaces of the upper surfaces of the outer cutters, and which are rotationally driven with respect to the outer cutters; and in the present invention, hair-raising rings which extend along the outer circumferential surfaces of the outer cutters and surround the outer cutters are provided on the head frame, and the upper end surfaces of these hair-raising rings are formed as flat surfaces.

Thus, since the upper end surfaces of the hair-raising rings are flat, the hair always contacts the upper end surfaces or upper outer circumferential surfaces of the hair-raising rings before contacting the outer cutters, in a manner that differs from the case of the conventional hair-introducing comb. Accordingly, even the hair lying flat against the skin can be raised upright since the tip ends of the hair contacts the upper end surfaces or upper outer circumferential surfaces of the hair-raising rings, and in this state, the hair is introduced into the hair entry apertures of the outer cutters. Consequently, even hair that is lying flat can be efficiently shaved. Furthermore, compared to the conventional electric shavers equipped with brushes, the structure of the hair-raising rings of the present invention is simple, and the hair adhering to the head frame can be simply and easily cleaned, thus making it possible to keep the shaver clean.

Furthermore, for electric shavers in which at least some of the hair entry apertures are formed as slits that reach the outer circumferential surfaces of the outer cutters, the height of (the upper end surfaces of) the hair-raising rings is set so that this height is higher than the inside bottom surfaces of the hair entry apertures formed in the outer circumferential surfaces of the outer cutters. As a result, the hair raised by the hair-raising rings is smoothly introduced into the hair entry apertures and cut without becoming caught on the inside bottom surfaces of the hair entry apertures.

It is further preferable that at least the upper portions of the hair-raising rings are formed from a material which has a larger frictional force than the metal material used for the outer cutters or a synthetic resin material used for the head frame. In concrete terms, these upper portions are formed using a rubber material.

As a result of such materials, hair is easily caught on the upper portions of the hair-raising rings, and the hair is raised more securely, thus allowing efficient shaving to be performed.

Furthermore, it is advisable that the outer circumferential surfaces of the hair-raising rings, as seen when the rings are sectioned in a plane perpendicular to the axial lines of the rings, be formed in a polygonal shape or in a shape of continuous waves. Generally, when hair is shaved with an electric shaver, the shaver, and therefore the outer cutters, are ordinarily moved around. Furthermore, in order to achieve an effective raising of hair, it appears to be better to have the hair come into contact at near right angles with the upper end portions of the outer circumferential surfaces of the hair-raising rings. However, when the outer circumferential surfaces of the hair-raising rings are round, only a single point of each hair-raising rings comes into contact with the hair at right angles. However, with the hair-raising rings having the outer circumferential surfaces formed in polygonal shape, the portion that comes into contact with the hair roughly at right angles during the shaver's circular movements is not a single point; rather, the circumferential surfaces of the hair raising rings make a surface contact with the hair, thus raising and cutting more hair at once. Furthermore, with the hair-raising rings having the outer circumferential surfaces formed with continuous waves, hair is guided into the bottoms of the wave forms and raised. Thus, more hair is simultaneously raised and cut in this case as well.

Furthermore, by way of setting the angle between the upper end surface and outer circumferential surface of each one of the hair-raising rings to be an acute angle, hair lying flat against the skin can be easily raised.

In addition, it is preferable that the hair-raising rings be installed in the head frame so that the hair-raising rings are movable up and down or so that such rings can be depressed. In this way, the hair-raising rings move up and down in response to configurations of the skin, and a superior skin contact is obtained.

BRIEF DESCRIPTION OF DRAWINGS

FIG. 5(*b*) shows a state in which the hair has been raised, and

FIG. 5(*c*) shows a state in which the raised hair is guided into a hair entry aperture formed in the corresponding outer cutter;

FIG. 10(*a*) is an overall sectional view illustrating a case in which the wave has a triangular shape;

FIG. 10(*b*) is an unfolded view illustrating a case in which the wave has a sine wave shape; and FIG. 10(*c*) is an unfolded view illustrating a case in which the wave has a saw-tooth shape;

DETAILED DESCRIPTION OF THE INVENTION

Figure 1:
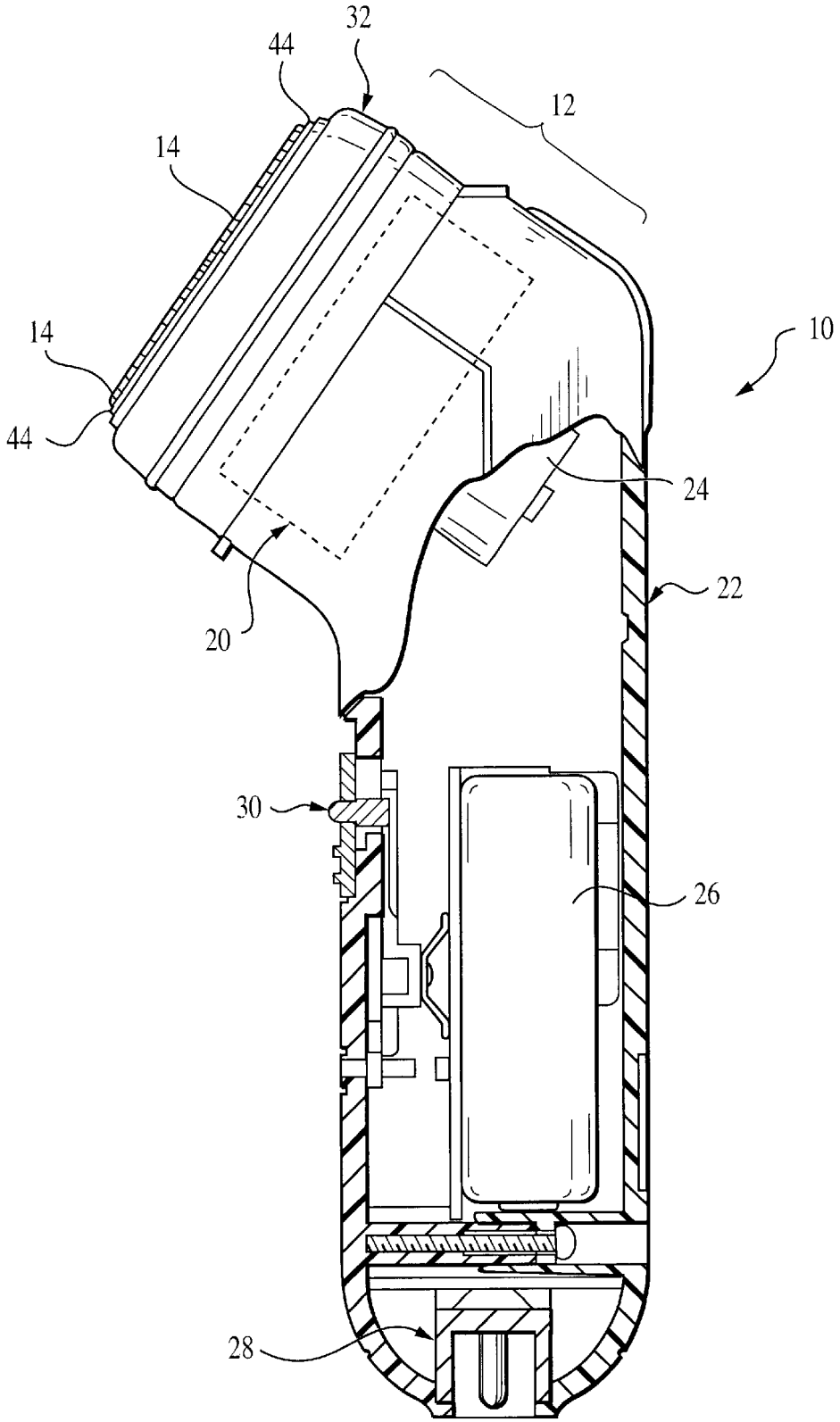
FIG. 1 is a cut-away side view showing the overall construction of the electric shaver of the present invention.

Below, a preferred embodiment of the present invention will be described in detail with reference to the accompanying drawings;

First, an outline of the overall construction of the electric shaver 10 will be described with reference to FIGS. 1 and 2. The embodiment will be described with reference to an electric shaver in which three outer cutters (and three corresponding inner cutter units) are provided in the head frame in a triangular arrangement and the upper surfaces of these outer cutters protrude from the head frame; however, the invention is applicable to electric shavers that have one or two outer and inner cutters or to electric shavers with four or more outer and inner cutters.

More specifically, the electric shaver 10 comprises: a synthetic resin housing 22 of which upper part is a shaver head 12 and in which a driving mechanism 20 for the inner cutter units 18 is accommodated; an electric motor 24 which is installed in the lower portion of the shaver head 12 inside the housing 22 and which operates the driving mechanism 20; a battery 26 which is accommodated inside the housing 22 and which supplies an electric current to the electric motor 24; a connector 28 which is installed in the lower portion of the housing 22 in order to supply a charging current to the battery 26 from the outside; a slide switch 30 which is attached to the surface of the housing 22 and used to switch the current supply from the battery 26 to the electric motor 24 on and off; and a head frame 32 to which the outer cutters 14 and inner cutter units 18 are attached and which is detachably mounted on the open upper portion of the shaver head 12 so that this head frame 32 covers the open area of the shaver head 12.

Figure 2:
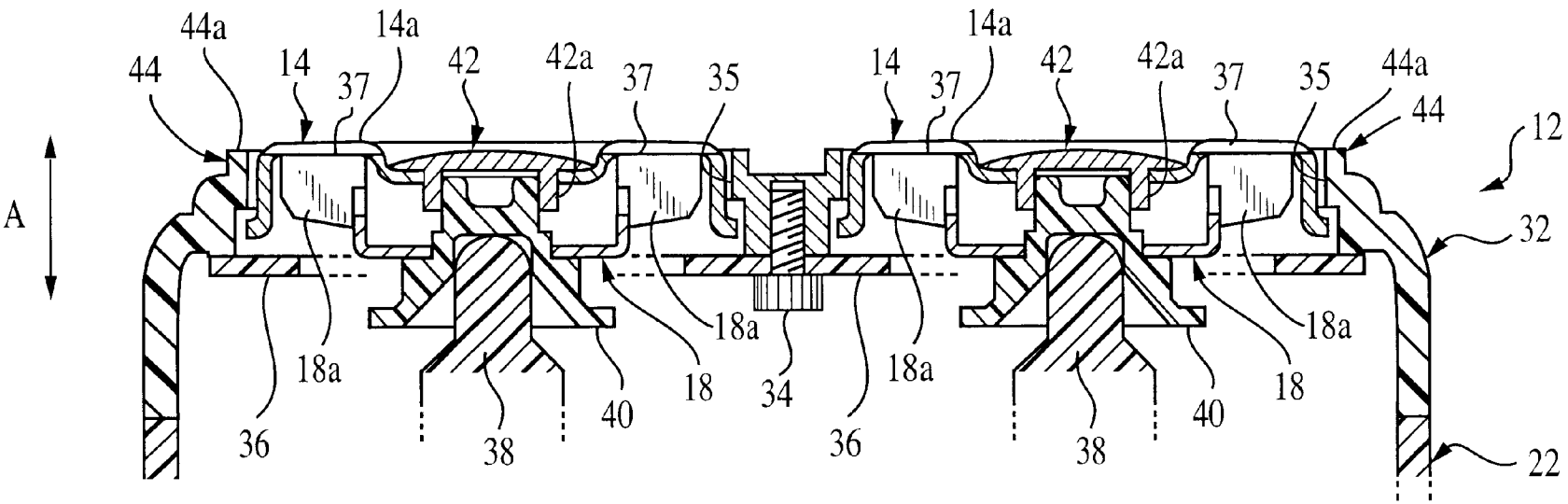
FIG. 2 is a sectional view showing the internal structure of the head frame and a portion of the shaver head of the electric shaver shown in FIG. 1.

The inner cutter units 18 (two inner cutter units 18 are shown in FIG. 2) have a plurality of inner cutter elements 18*a* which contact the inside surfaces of the upper surfaces 14*a* of the outer cutters 14 (only two outer cutters 14 are shown in FIG. 2). The inner cutter units 18 are rotationally driven relative to the outer cutters 14 and act together with the outer cutters 14 so as to cut the hair introduced into the hair entry apertures (described later) of the outer cutters 14.

Next, the structure of the head frame 32 will be described in detail with reference to FIG. 2.

A cutter retainer frame 36 which is attached in a detachable fashion by means of an attachment screw 34 is disposed on the inside surface of the head frame 32. The outer cutters 12 and inner cutter units 18 are held between this cutter retainer frame 36 and the head frame 32 and are thus prevented from dropping toward the bottom of the shaver head 12.

The outer cutters 14 are mounted so that the upper surfaces 14*a* of these outer cutters 14 in which a plurality of hair entry apertures 37 are formed protrude from round holes 35 formed in the head frame 32.

Moreover, connecting members 40 (only two connecting members 40 are shown in FIG. 2) made of a synthetic resin which engage with the tip ends of drive shafts 38 (constituting elements of the driving mechanism 20) that cause the inner cutter units 18 to rotate are attached to the central portions of the inner cutter units 18. The tip ends of these connecting members 40 located on the outer cutters 14 side are inserted (in a manner that the connecting members 40 is rotatable) into tube parts 42*a* formed in the undersurfaces of disk member 42 which are attached to the central portions of the outer cutters 14, so that centering of the inner cutter units 18 and outer cutters 14 can be accomplished. Furthermore, the drive shafts 38 constantly urge the inner cutter units 18 upward (or toward the outer cutters 14) by means of springs (not shown). The rotational force of the electric motor 14 is transmitted to the drive shafts 38 by means of a transmission mechanism (not shown) which consists of a gear mechanism, etc. and which forms a part of the driving mechanism 20.

Next, the basic construction of the hair-raising rings 44 which characterizes the present invention will be described.

Figure 3:
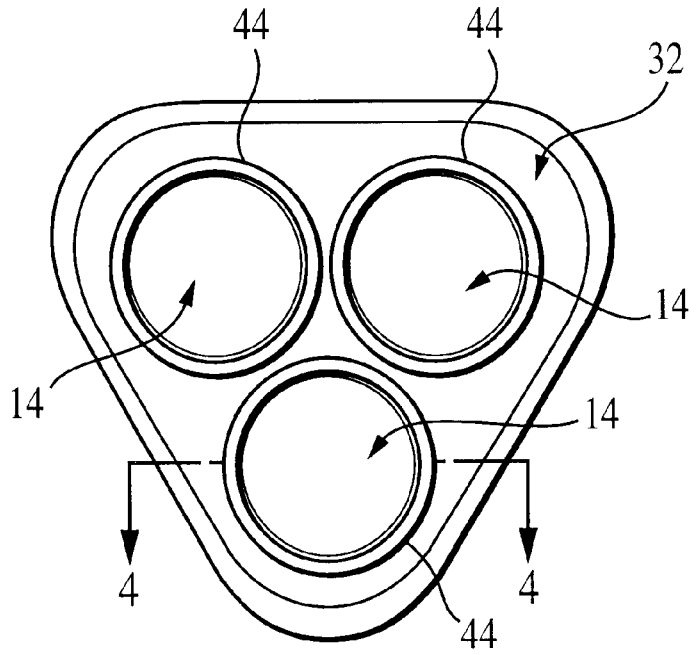
FIG. 3 is a top view of the head frame shown in FIG. 2.
Figure 4:
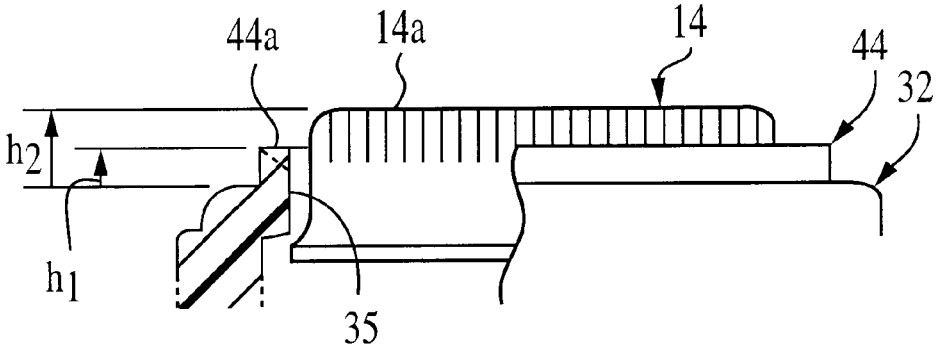
FIG. 4 is a partial sectional taken along the lines 4—4 in FIG. 3.

As shown in FIGS. 2 through 4, hair-raising rings 44 (only two hair-raising rings 44 are shown in FIG. 2) are formed on the surface of the head frame 32 for each outer cutter 14 so that these hair-raising rings 44 extend along the outer circumferential surfaces of the outer cutters 14 and thus surround the outer cutters 14. Furthermore, the upper end surfaces 44*a* of the hair-raising rings 44 are not formed in a comb shape that consists of recesses and projections as in conventional hair-raising rings, but the upper end surfaces 44*a* are instead formed, for example, as flat surfaces that are substantially parallel to the upper surfaces 14*a* of the outer cutters 14. Moreover, the outer circumferential surfaces of the hair-raising rings 44 rise at substantially right angles with reference to the surface of the head frame 32. Besides a construction in which the upper end surfaces 44*a* of the hair-raising rings 44 are formed flat so as to be substantially parallel to the upper surfaces 14*a* of the outer cutters 14, it is also possible to employ a construction in which the upper end surface 44*a* of the hair-raising rings 44 are formed as reverse-tapered surfaces that gradually lower toward the inside as indicated by the dotted line in FIG. 4.

Next, the hair-raising action done by the hair-raising rings 44 will be described with reference to FIG. 5 wherein only one hair-raising ring 44 is illustrated.

Figure 5:
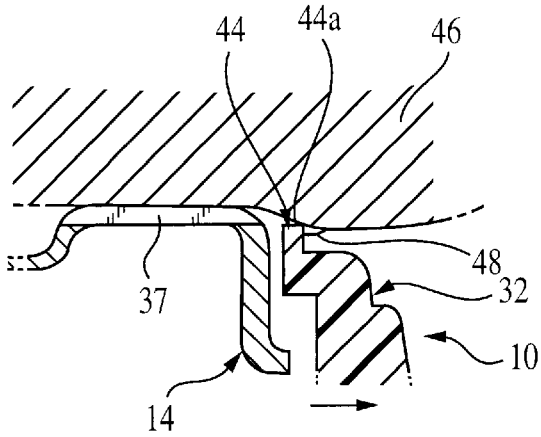
FIG. 5 is an explanatory illustration showing the hair raising action performed by the hair-raising rings of the present invention, in which FIG. 5(*a*) shows a state in which the tip end of a hair has contacted the outer circumferential surface of one of the hair-raising rings.
Figure 5:
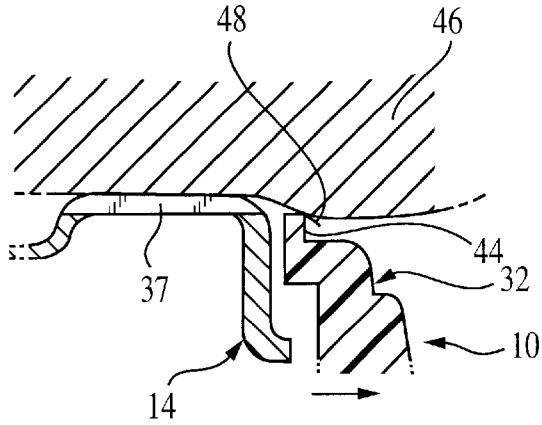
Figure 5:
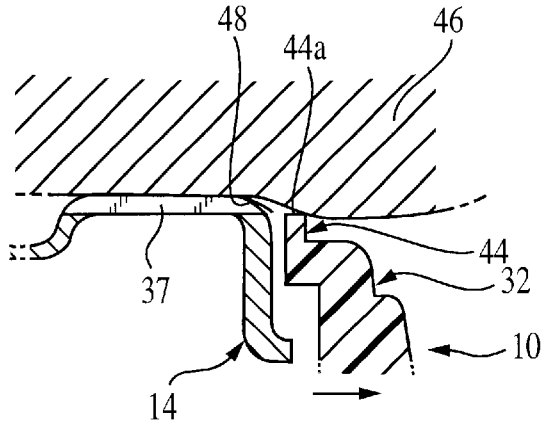

In FIG. 5, when the electric shaver 10 is held in hand and moved relative to the skin 46 in the direction indicated by the arrow while the surface of the head frame 32 from which the outer cutters 14 protrudes is caused to contact the skin 46, the tip ends of any hair 48 lying flat against the skin will first contact the upper portion of the outer circumferential surface of the hair-raising ring 44 as shown in FIG. 5(*a*).

When the electric shaver 10 is moved further in the same direction as indicated by an arrow from this state, since the tip ends of the hair 48 is caught on the upper portion of the outer circumferential surface of the hair-raising ring 44 as shown in FIG. 5(*b*), the hair 48 is caused to stand up in the opposite direction from the direction in which the hair 48 was initially lying, while the hair 48 is drawn upward by the upper end surface of the hair-raising ring 44.

Then, when the electric shaver 10 is moved even further in the same direction as indicated by an arrow, the engagement between the tip end of the hair 48 and the outer circumferential surface of the hair-raising ring 44 is released as shown in FIG. 5(*c*), and the hair 48 stands upright, while attempting to return in the direction in which the hair 48 was originally lying, in the space formed by the outer circumferential surface of the outer cutter 14, upper end surface 44*a* of the hair-raising ring 44, inner circumferential surface of the hair-raising ring 44 and skin 46. In this state, the hair 48 contacts the outer cutter 14. Accordingly, since the hair 48 is introduced in a standing state into the hair entry aperture 37 formed in the outer cutter 14, hair 48 that was initially lying flat can also be efficiently cut.

In the above, as shown in FIG. 5(*a*), when the electric shaver 10 is moved, hair 48 whose tip end initially contacts the outer circumferential surface of the hair-raising ring 44 can be raised from a state in which the hair 48 is lying flat, while hair 48 whose root portion initially contacts the outer circumferential surface of the hair-raising ring 44 cannot be raised. However, the person using an electric shaver ordinarily shaves the hair while moving the shaver circularly. Accordingly, in the use of the shaver of the present invention as well, hair 48 whose root portion contacts the hair-raising ring 44 at a given time will at some other time contact the hair-raising ring 44 with the tip end portion. Thus, even if the hair 48 is lying flat, they will be raised by the hair-raising ring 44 and cut.

The hair-raising rings 44 of the shown embodiment are not formed in a comb shape that consists of recesses and projections as in conventional hair-raising rings but are instead formed with flat upper end surfaces. Accordingly, hair 48 that is lying flat against the skin always contact the outer circumferential surfaces of the hair-raising rings 44 and is raised when such hair 48 enter the regions of the outer cutters 14. More specifically, in the case of conventional hair-raising means, hair 48 that passes the recessed portions of the recesses and projections contacts the outer cutters 14 without being raised and then passes the outer cutters 14 without being cut. In the case of the hair-raising rings 44 of the present embodiment, however, such an event is rare.

Next, the concrete structures or shapes of various embodiments of the hair-raising rings 44 will be described with reference to various concrete examples.

Firstly, the hair-raising rings 44 used with outer cutters 14 in which at least some of the hair entry apertures 37 are formed as slits so as to reach the outer circumferential surfaces 14*b* of the outer cutters 14 will be described.

Figure 6:
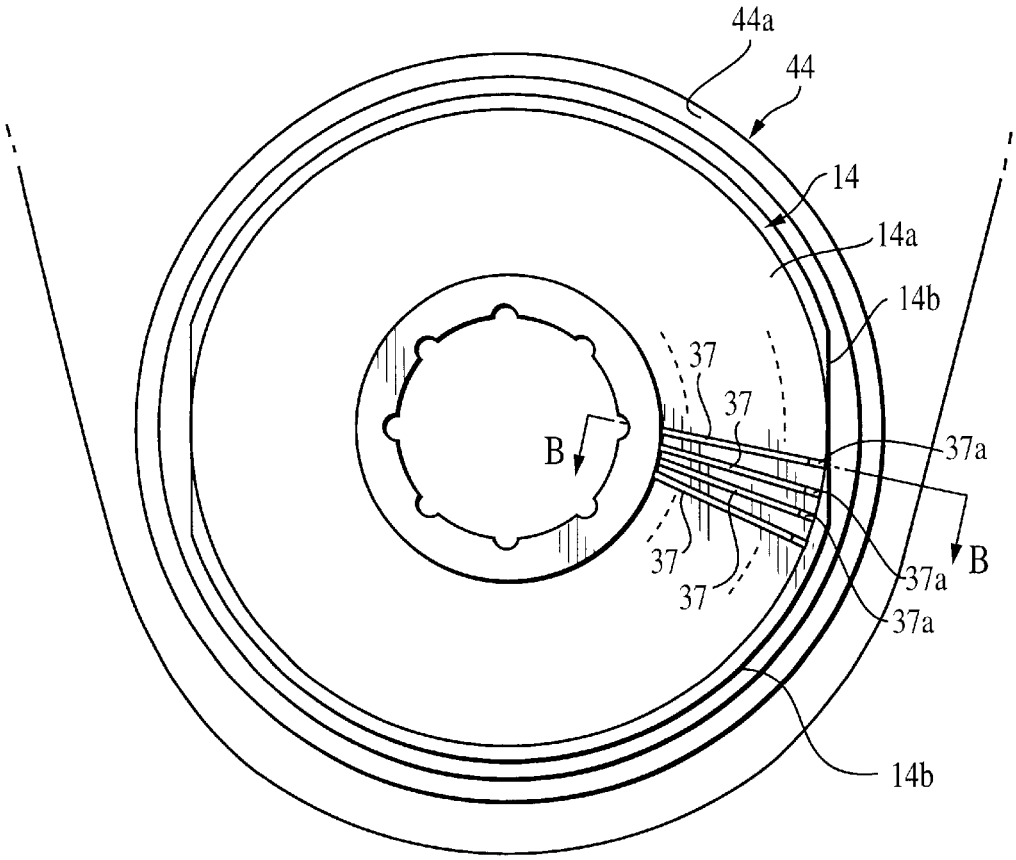
FIG. 6 is a top view showing one example of an outer cutter of the present invention.

One example of such outer cutters 14 is shown in FIG. 6. In this outer cutter 14, all of the hair entry apertures 37 are formed as slits which extend toward the edge portions from the central portion of the outer cutter 14, and the end portions of the hair entry apertures 37 in the direction of the circumferential edges of the outer cutter 14 reach the outer circumferential surface 14*b* of the outer cutter 14.

Figure 7:
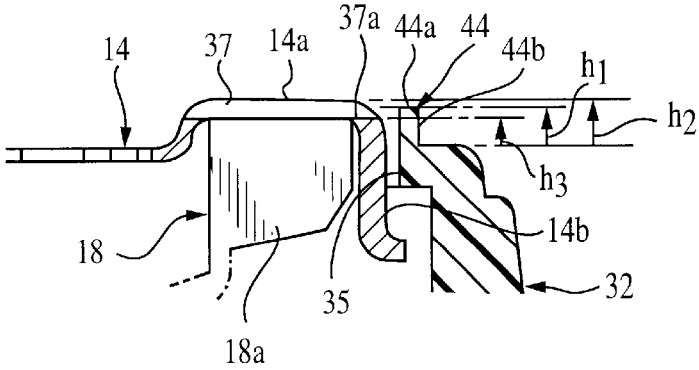
FIG. 7 is a sectional view taken along the line B—B in FIG. 6, showing a case in which the hair-raising rings are formed as integral parts of the head frame around the rims of the round holes for the outer cutters.

As shown in FIG. 7, the hair-raising ring 44 used in such an outer cutter 14 is designed so that the height $h_1$ of the upper end surface 44*a* of the hair-raising ring 44 is higher than the height $h_3$ of the inside bottom surface 37*a* of the hair entry aperture 37 formed in the outer circumferential surface 14*b* of the outer cutter 14.

When the outer cutters 14 are installed on the head frame 32 along with the inner cutter units 18 so that the outer cutters 14 and inner cutter units 18 are moved upward and downward, the distance of the upward and downward movement of the outer cutters 14 and inner cutter units 18 is regulated to a specified range, so that even if the outer cutters 14 are moved upward or downward, the relationship of the height $h_1$ of the upper end surfaces 44*a*, the height $h_3$ of the inside bottom surfaces 37*a* and the height $h_2$ of the upper surfaces 14*a* always satisfies the above-described relationship ($h_2>h_1>h_3$).

If the height $h_1$ of the upper end surfaces 44*a* of the hair-raising rings 44 is thus set so as to be higher than that of the inside bottom surfaces 37*a* of the hair entry apertures 37, then the hair raised by the hair-raising rings 44 tend not to interfere with the inside bottom surfaces 37*a* when the hair is introduced into the hair entry apertures 37 of the outer cutters 14 (i.e., the hair tends not to catch on the inside bottom surfaces 37*a*), so that the hair smoothly enters the hair entry apertures 37 and is cut.

Figure 8:
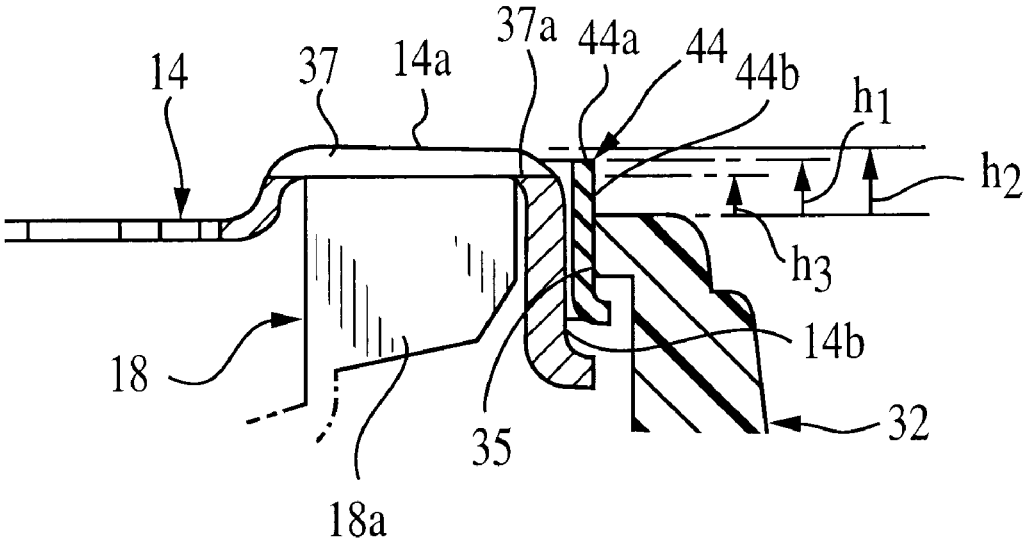
FIG. 8 is a sectional view along line B—B in FIG. 6 showing a case in which the hair-raising rings are fastened to the inner circumferential surfaces of the round holes in the head frame.

The hair-raising ring 44 shown in FIG. 7 is formed integrally to the head frame 32 which extends in ring form along the rim of the circular hole 35 in which the outer cutter 14 installed in the head frame 32 is mounted. However, instead of this structure, it is also possible to use a tube-form hair-raising ring 44 manufactured separately from the head frame 32. In this case, such hair-raising rings 44 are fastened to the inner circumferential surfaces of the circular holes 35 formed in the head frame 32 so that the tip ends of the hair-raising rings 44 protrude from the upper surface of the head frame 32 as shown in FIG. 8, which shows only one hair-raising ring 44 and one circular hole 35. In this way as well, the hair-raising rings 44 can be installed on the head frame 32 for the respective outer cutters 14 so that these hair-raising rings 44 extend along the outer circumferential surfaces of the outer cutters 14 and surround the outer cutters 14.

Secondly, since the function of the hair-raising rings 44 is to catch and raise (with their upper end portions) hair that is lying flat against the skin, it is desirable that at least the upper end portions (upper end surfaces and upper portions of the outer circumferential surfaces of the rings) that contact the hair have a structure and material that allows easy catching of the hair.

As to the other members of the electric shaver 10 surrounding the hair-raising rings 44, the cutting blades themselves of the outer cutters 14 and inner cutter units 18 are formed from a metal material, while the head frame 32 is ordinarily molded from a resin (from the standpoints of manufacturing cost and weight reduction).

Accordingly, when the hair-raising rings 44 are molded integrally to the head frame 32 as described above, the hair-raising rings 44 are formed from the same resin material as the head frame 32. However, when the hair-raising rings 44 are manufactured separately from the head frame 32 and fastened to the head frame 32, if a material which has a higher coefficient of friction than the metal material constituting the outer cutters 14, etc., or the resin material used for the head frame 32 is used, the hair can be more easily caught, and the hair can be effectively raised by the hair-raising rings 44.

Rubber materials, etc., are an example of the types of materials that can be used for the hair-raising rings. The hair-raising rings 44 may be formed entirely from such a material with a high coefficient of friction, or only the upper potions that directly come into contact with the hair may be formed from such a material with a high coefficient of friction. Furthermore, in order to heighten the frictional effect while maintaining the strength of the hair-raising rings 44, it is possible to coat the upper surfaces (outer circumferential surfaces and upper end surfaces) of the hair-raising rings 44 with such a material that has a high coefficient of friction.

In the respective embodiments described above, the hair-raising rings 44 are formed in a ring shape or cylindrical shape, and the cross sectional shape of the outer circumferential surfaces as seen when cut on a plane perpendicular to the axis of the ring is also circular or close to circular.

However, when hair is shaved with the electric shaver 10, the outer cutters 14 are ordinarily moved so that the outer cutters 14 draw arcs on the skin. Accordingly, in order to effectively raise the hair, it seems better to employ a thicker contact angle (i.e., an angle closer to a right angle) between the hair to be cut and the upper end portions of the outer circumferential surfaces 44*b* of the hair-raising rings 44*r*. However, with the hair-raising rings 44 that have round outer circumferential surfaces 44*b*, each one of the hair-raising rings contacts the hair at right angles only at one single point thereof.

Figure 9:
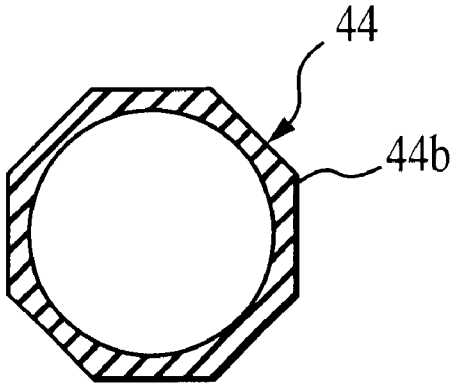
FIG. 9 shows another embodiment of one of the hair-raising rings which is made in a polygonal shape, being a sectional view taken along a plane perpendicular to the axial direction of the axial line of the hair-raising ring.

Accordingly, if the (outer circumferential surface 44*b* of the) hair-raising ring 44 is formed polygonal as shown in FIG. 9, the areas that contact the hair substantially at right angles during the circular movement of the shaver will be lines rather than points. As result, more hairs can be simultaneously gathered, raised and efficiently cut.

Figure 10A:
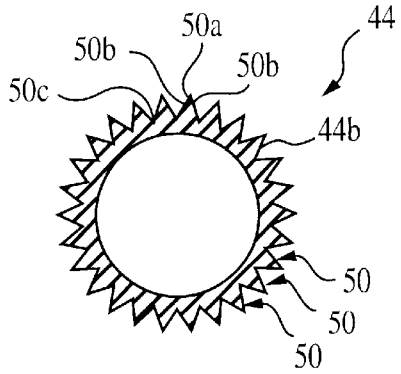
FIG. 10 shows another embodiment of the hair-raising ring wherein the hair-raising ring has a continuous wave form.
Figure 10B:
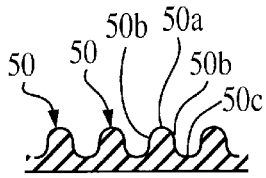
Figure 10C:
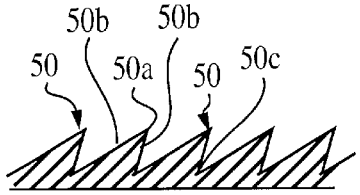

Furthermore, if the outer circumferential surface 44*b* of the hair-raising ring 44 is formed with a plurality of continuous waves 50 as shown in FIG. 10, hair contacting the top portions 50*a* and inclined portions 50*b* of such wave forms 50 can be raised while being guided into the bottom portions 50*c*. Thus, more hair can be simultaneously raised and cut in this case as well. Compared to the polygonal hair-raising rings 44, the inclined portions 50*b* of the wave 50 have more varied orientations. Accordingly, a wide range of hair can be raised simultaneously regardless of the direction of movement of the hair-raising rings 44.

If the bottom portions 50*c* of the wave 50 are aligned with the positions of the hair entry apertures 37 formed in the outer cutters 14, then hair can be efficiently introduced into the hair entry apertures 37 and cut, since the hair is guided into the bottom portions 50*c* as described above.

As the individual waveform, the triangle is shown in FIG. 10(*a*). However, other waveform shapes include a sine wave shape (see FIG. 10(*b*)) and a saw-tooth shape (see FIG. 10(*c*)), etc. The size and spacing of the respective waves 50, and the angularity of the top portions 50*a*, etc. are set at appropriate angles with consideration given not only to the conditions of raising of the hair but also the conditions of contact with the skin (feeling on the skin).

Figure 11:
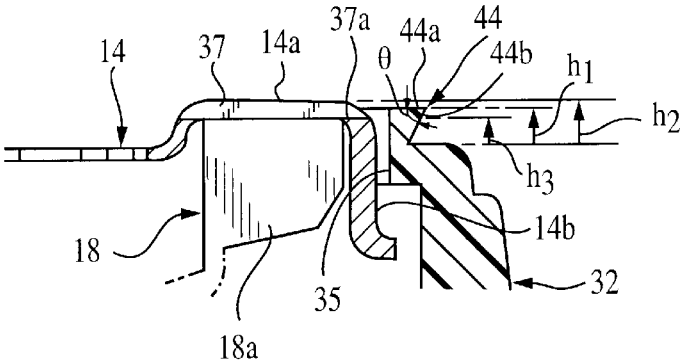
FIG. 11 is a sectional view of the essential section of the head frame of the shaver of the present invention, showing another embodiment of the hair-raising ring in which the angle between the outer circumferential surface and the upper end surface of the hair-raising ring is an acute angle.

In addition, in the embodiments described above, the angle θ between the upper end surface 44*a* and outer circumferential surface 44*b* of the hair-raising ring 44 is set to be approximately 90°. If this angle is formed as an acute angle as shown in FIG. 11, hair lying flat against the skin can be drawn upward by the portion where the upper end surface 44*a* meets the outer circumferential surface 44*b*, so that the hair can easily be raised along the outer circumferential surface 44*b*.

The hair-raising rings 44 can be installed on the head frame 32 so as to be movable up and down.

With this structure, the hair-raising rings 44 are moved up and down in conformity to depressions and protrusions of the skin, so that superior contact with the skin is assured. As previously described, some electric shavers are designed so that the outer cutters 14 and inner cutter units 18 are mounted to the head frame 32 so that these parts can be moved up and down in the direction of an arrow A. Accordingly, a construction in which the hair-raising rings are moved up and down together with the outer cutters 14 and inner cutter units 18 is convenient, because such a structure is able to maintain the above-described desirable relationship between the upper end surfaces 44*a* of the hair-raising rings 44 and the upper surfaces of the outer cutters 14 (e.g., $h_3<h_1<h_2$, etc.).

Figure 12:
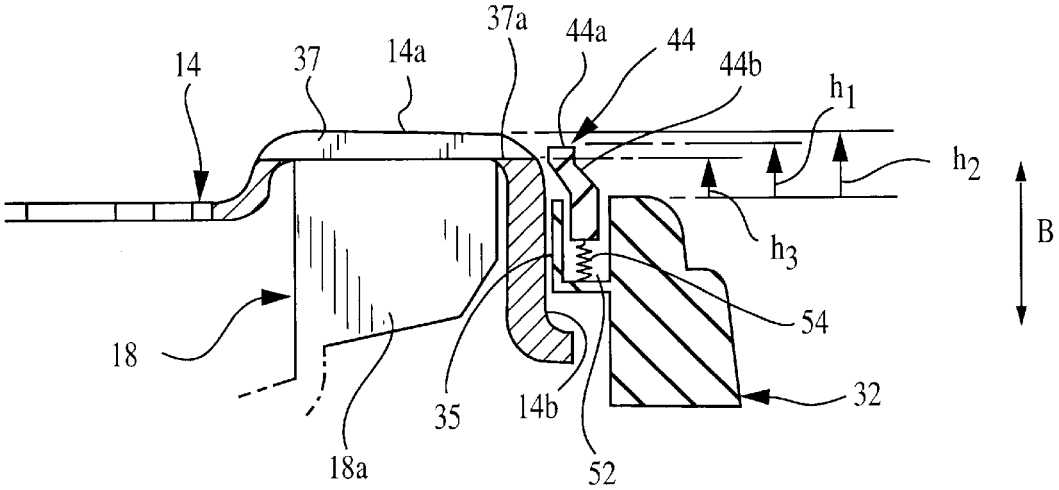
FIG. 12 is a sectional view of essential section of the head frame, showing a still another embodiment of the hair-raising rings in which the hair-raising rings are attached so that these rings are free to move upward and downward.

FIG. 12 illustrates the construction in which the hair-raising rings 44 are installed on the head frame 32 so that the hair-raising rings 44 are moved up and down in the direction of an arrow B. In particular, in FIG. 12, ring-form circumferential grooves 52 (only one groove 52 is shown) are formed in the upper surface of the head frame 32 for each one of the outer cutters 14 so that these grooves 52 surround the outer cutters 14 (only one outer cutter 14 is shown), and the hair-raising rings 44 (only one ring 44 is shown) are held in these circumferential grooves 52 by driving means 54 such as springs, etc. With this structure, when the upper end surfaces 44*a* of the hair-raising rings 44 contact the skin, the hair-raising rings 44 are retracted into the circumferential grooves 52, and when the upper end surfaces 44*a* of the hair-raising rings 44 are separated from the skin, the hair-raising rings 44 return to their original positions by being pressed by the driving means 54.

In the embodiments above, the upper end surfaces of the hair raising rings can be lower than the upper surfaces of the outer cutters. In this cases, as shown in FIG. 4, the height h1 of the hair raising ring 44 from the head frame 32 is set so as to be smaller than the height h2 of the outer cutter from the head frame 32, so that the upper end surface 44*a* of the hair raising ring 44 is lower than the upper surface 14*a* of the outer cutter 14.

Various preferred embodiments of the present invention are described above. However, the present invention is not limited to the above-described embodiments; and it goes without saying that numerous modifications and variations may be made without departing from the spirit of the present invention.

When the electric shaver of the present invention is used, since the upper end surfaces of the hair-raising rings are formed flat, hair extending in the direction of the movement of the outer cutters always contacts the upper end surfaces and outer circumferential surfaces of the hair-raising rings before contacting the outer cutters, and such a contact is made without slipping out of the recesses and projections as in conventional hair-introducing combs. Accordingly, even hair lying flat on the skin is raised because the upper end surfaces and outer circumferential surfaces of the hair-raising rings contact the tip ends of the hair. Consequently, this hair is introduced into the hair entry apertures of the outer cutters in a raised state, so that even such hair which has been lying flat can be efficiently cut. Furthermore, compared to conventional electric shavers equipped with a brush, there are few recesses or projections on the surface of the head frame, and the structure of the hair-raising rings is simple. Accordingly, the shaving debris can be easily cleaned away, and the shaver can be maintained clean.

What is claimed is:

1. The electric shaver comprising:

a head frame;

at least one outer cutter which is mounted in the head frame so that the upper surface of the outer cutter, in which a plurality of hair entry apertures are formed, protrudes from a circular hole formed in the head frame, and at least one inner cutter unit which rotates with respect to the at least one outer cutter and has a plurality of inner cutter elements that contact the inside surface of the upper surface of the at least one outer cutter; wherein at least one hair-raising ring is provided in the head frame so as to surround the at least one outer cutter, an upper end surface of the at least one hair-raising ring is formed flat, and at least one hair-raising ring is a polygonal shape.

2. The electric shaver comprising;

a head frame;

at least one outer cutter which is mounted in the head frame so that the upper surface of the outer cutter, in which a plurality of hair entry apertures are formed, protrudes from a circular hole formed in the head frame, and at least one inner cutter unit which rotates with respect to the at least one outer cutter and has a plurality of inner cutter elements that contact the inside surface of the upper surface of the at least one outer cutter; wherein at least one hair-raising ring is provided in the head frame so as to surround the at least one outer cutter, an upper end surface of the at least one hair-raising ring is formed flat, and an angle between an upper end surface and outer circumferential surface of the at least one hair-raising ring is set to be an acute angle.

3. The electric shaver comprising:

a head frame;

at least one outer cutter which is mounted in the head frame so that the upper surface of the outer cutter, in which a plurality of hair entry apertures are formed, protrudes from a circular hole formed in the head frame, and at least one inner cutter unit which rotates with respect to the at least one outer cutter and has a plurality of inner cutter elements that contact the inside surface of the upper surface of the at least one outer cutter; wherein at least one hair-raising ring is provided in the head frame so as to surround the at least one outer cutter, an upper end surface of the at least one hair-raising ring is formed flat, at least one of the hair entry apertures of the at least one outer cutter is formed in the shape of a slit which reaches an outer circumferential surface of the at least one outer cutter, the upper end surface of the at least one hair-raising ring is positioned higher than inside bottom surfaces of the hair entry apertures formed in the outer circumferential surface of the at least one outer cutter, at least one upper portion of the at least one hair-raising ring is formed from a material that has a larger frictional force than a metal material used for the at least one outer cutter and a synthetic resin material used for the head frame, at least an upper portion of the at least one hair-raising ring is formed with a rubber material, and the at least one hair-raising ring is a polygonal shape.

4. The electric shaver according to claim 3, wherein an outer circumferential surface of the at least one hair-raising ring is shaped as a wave.

5. The electric shaver according to claim 4, wherein an angle between an upper end surface and outer circumferential surface of the at least one hair-raising ring is set to be an acute angle.

6. The electric shaver according to claim 5, wherein the at least one hair-raising ring is installed in the head frame so as to be movable up and down.

* * * * *